US007300126B2

(12) United States Patent
Uraki et al.

(10) Patent No.: US 7,300,126 B2
(45) Date of Patent: Nov. 27, 2007

(54) LIQUID EJECTING DEVICE

(75) Inventors: Shingo Uraki, Machida (JP); Katsuaki Komatsu, Hachioji (JP); Akiko Kitami, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 300 days.

(21) Appl. No.: 11/189,421

(22) Filed: Jul. 26, 2005

(65) Prior Publication Data

US 2006/0033766 A1 Feb. 16, 2006

(30) Foreign Application Priority Data

Aug. 11, 2004 (JP) ..... 2004-234572

(51) Int. Cl.
*B41J 29/38* (2006.01)

(52) U.S. Cl. ..... 347/10; 347/14

(58) Field of Classification Search ..... 347/10–19

See application file for complete search history.

(56) References Cited

U.S. PATENT DOCUMENTS 6,053,596 A * 4/2000 Nakano et al. ..... 347/15

* cited by examiner

*Primary Examiner*—Stephen Meier
*Assistant Examiner*—Jason Uhlenhake
(74) *Attorney, Agent, or Firm*—Cohen Pontani Lieberman & Pavane LLP

(57) ABSTRACT

The present liquid ejecting device adjusts the cross-talk amount to a range of ± 15 %, by providing: a recording head having actuators which generate the ejection energy for ejecting the liquid from a plurality of nozzles for each of the plurality of nozzles; a drive circuit to generate the drive signal for driving the actuator; and an adjusting circuit for adjusting at least one of the rising time constant and the falling time constant of the waveform of the drive signal to a time period more than 30 nsec and less than 150 nsec before the drive signal reaches the actuator.

12 Claims, 9 Drawing Sheets

FIG. 6 ( a )
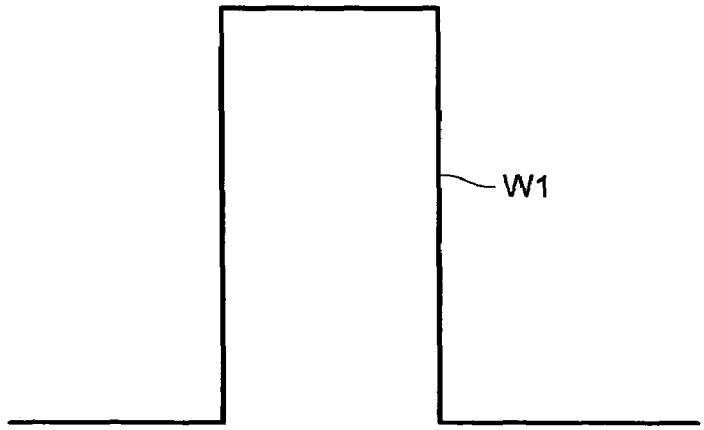
FIG. 6 ( b )
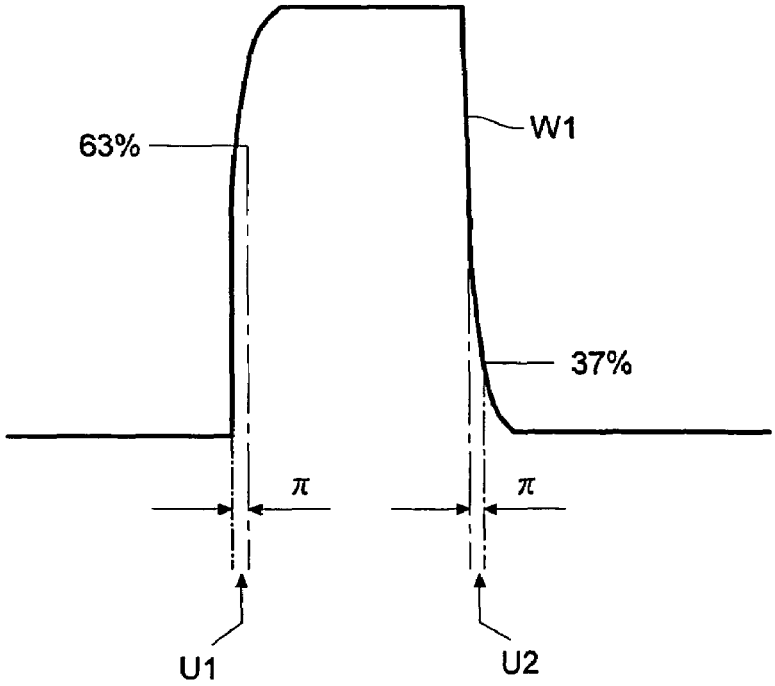

LIQUID EJECTING DEVICE

BACKGROUND OF THE INVENTION

1. Field of the Invention

The present invention relates to a liquid ejecting device, particularly to a liquid ejecting device used for an inkjet printer or an apparatus for coating liquid material.

2. Description of the Related Art

As an image recording apparatus for recording an image on a recording medium such as a paper sheet, the inkjet printer is generally known. In the inkjet printer, the liquid ejecting device for ejecting the ink is mounted. This liquid ejecting device is provided with recording heads for ejecting the ink from a plurality of nozzles and a drive circuit for driving the recording heads.

Herein, in the recording heads, for ejecting the ink from each of a plurality of nozzles, actuators which are deformed corresponding to each nozzle, are provided. The actuator is connected to the drive circuit, and swelled/expanded and contracted based on the waveform of a drive signal inputted from this drive circuit, and ejects the ink from the nozzle. Hereupon, in the liquid ejecting device, an RC filter circuit is formed of a resistance such as a FFC (Flexible Flat Cable) which is a transmission path of the drive signal, and a capacitance of the driven actuator. Therefore, when a drive signal is transmitted from the drive circuit to the actuator, the high frequency component of the drive signal is lost through the RC filter circuit. As the result, there is a possibility that the drive signal of the waveform optimized for the driver is not transmitted to the actuator. Particularly, when a number of actuator arrangements are increasing, a deformation of a shape of the each drive signal waveform is becoming unacceptable.

In order to solve this problem, recently, a drive circuit in which an individual power amplifier is provided for each of head units instead of a common amplifier, and by which the drive signal of the drive waveform generation circuit is supplied to a plurality of power amplifiers and a plurality of head units are driven, is developed (for example, Tokkai No. 2000-325882). Hereby, a total of the capacitance of the actuator which is driven by one power amplifier is divided and becomes small, and the time constant ($\pi$=RC) itself can be made small. As smaller the time constant is, the input waveform and the output waveform of the drive signal to the RC filter become almost the same shape. Accordingly, a loss of the high frequency component through the transmission path can be reduced, and the waveform of the applied drive signal can be transmitted to the actuator as it is. Then, when this drive circuit is used, the actuator can be driven without the waveform of the applied drive signal being so much changed. As the result, an ejected drop speed or an ink amount of the ink drop ejected from each nozzle can be stabilized and equalized.

Hereupon, as described above, in the case where the actuator which is deformed corresponding to each nozzle, is provided, when the ink is ejected from each nozzle, there is a case where the vibration of the actuator wall influences the ejected drop speed from the adjoining nozzle. FIG. 9 represents the drop speeds V1, V2, V3, V4, V5, V6 of each of nozzles when the ink is simultaneously ejected from a plurality of nozzles, and the drop speed V7 when the ink is ejected from a single nozzle. As can be clearly seen also from FIG. 9, in the ejected drop speed V3 when simultaneously ejected from a plurality of nozzles, and the ejected drop speed V7 when the ink is ejected from a single nozzle, although the ejection is conducted from the same nozzle, the ejected drop speed is not equal. Like this, the phenomenon that the ejected drop speed is different in a case where the ink is simultaneously ejected from a plurality of nozzles, and in a case where the ink is ejected from a single nozzle, is called cross-talk. Further, as an index expressing a degree of the cross-talk, there is a cross-talk amount. The cross-talk amount is, when considered being aimed to one nozzle (aimed nozzle), in a ratio of the ejected drop speed (the drive speed of a plurality of nozzles) of the aimed nozzle when the ink are simultaneously ejected from a plurality of nozzles, and the ejected drop speed (the drive speed of a single nozzle) of the aimed nozzle when the ink is ejected from only an aimed nozzle, expressed by "the cross-talk amount=((the drive speed of a plurality of nozzles)/(the drive speed of a single nozzle)−1)×100 (%)".

When the absolute value of the cress-talk amount is closer to 0%, it is shown that the speed difference between the time of a plurality of nozzle drive, and the time of a single nozzle drive, is small. That is, when the absolute value of the cress-talk amount is large, because the speed difference between the time of a plurality of nozzle drive, and the time of a single nozzle drive is large, a dislocation of the impact position of the ink drop on a media is generated by the difference of the ejecting pattern, and the possibility that the image quality is lowered, is high.

Particularly, when the drive circuit written in the Tokkai No. 2000-325882 is applied, the waveform of the applied drive signal is transmitted to the actuator as it is. As the result, the rising and falling edge of the waveform become sharp and deform channel wall rapidly, and the vibration of the channel is easily transmitted to the adjoining channel. Particularly, there is a problem that the sharp deformation of the channel wall increases the ejected drop speed from the adjoining nozzle. That is, the influence which affects the adjoining nozzle meniscus, becomes large, and as the result, it becomes a factor that the absolute value of the cross-talk amount between adjoining nozzles is increased.

SUMMARY OF THE INVENTION

The object of the present invention is to solve the above-described problems. Further object of the present invention is to provide a liquid ejecting device whose cross-talk amount is reduced. Yet further object of the present invention is to provide a liquid ejecting device by which, while the ejecting control for each nozzle being possible, the cross-talk amount between the adjoining nozzles is reduced.

These and other objects are attained by the liquid ejecting device having: a recording head having the actuator by which the ejecting energy for ejecting the liquid from a plurality of nozzles is generated for each of the plurality of nozzles; a drive circuit by which the drive signal for driving the actuator is generated; and an adjusting circuit for adjusting at least one of the rising time constant and the falling time constant of the waveform of the drive signal to a time constant more than 30 nsec and less than 150 nsec.

The invention itself together with further object and attendant advantages, will best be understood by reference to the following description taken in conjunction with the accompanying drawings.

BRIEF DESCRIPTION OF THE DRAWINGS

FIGS. 6(*a*) and 6(*b*) are explanatory views expressing a modified example of a waveform of a drive signal before and after granting a time constant;

In the following description, like parts are designated by like reference numbers throughout the several drawings.

DESCRIPTION OF THE PREFERRED EMBODIMENT

Figure 1:
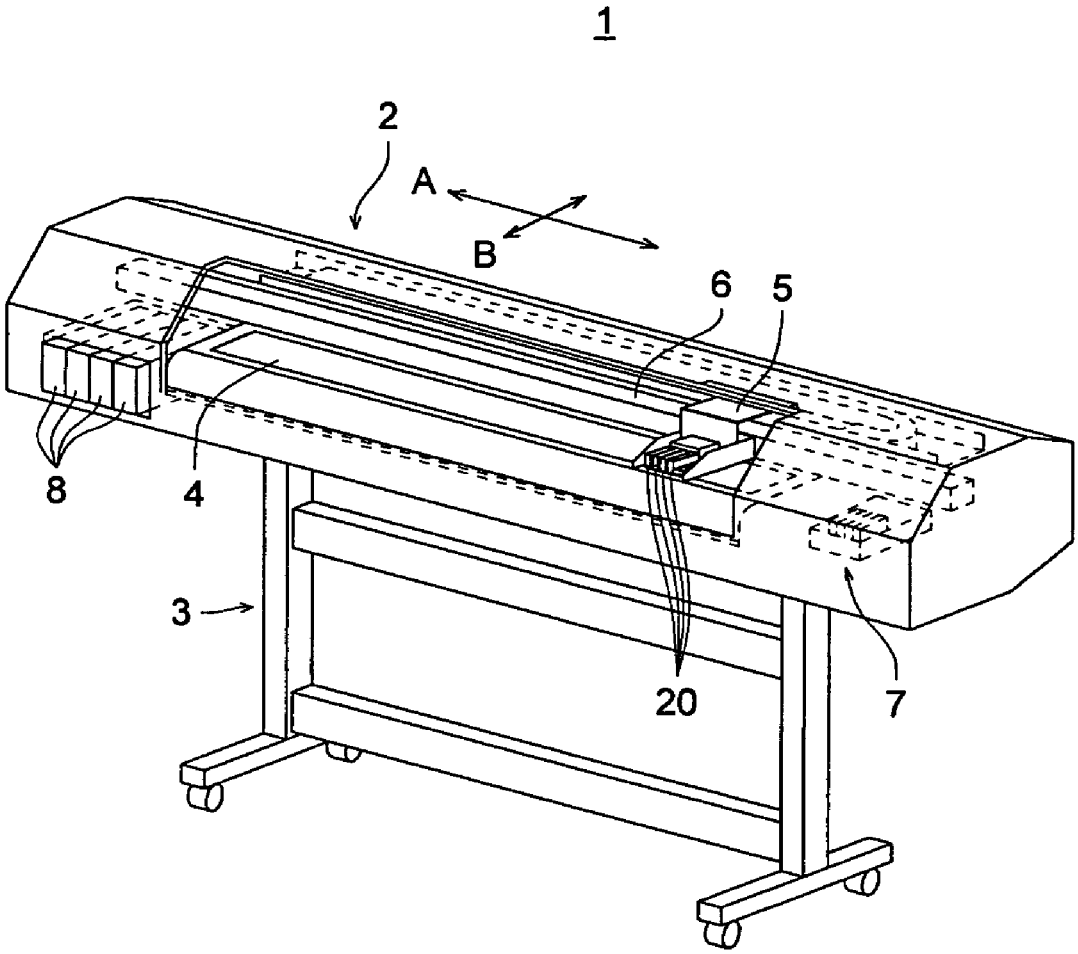
FIG. 1 is a perspective view expressing an inkjet printer provided with a liquid ejecting device.

Referring to the drawings, examples of the present invention will be described below.

FIG. 1 is a perspective view expressing an outline structure of an inkjet printer. As shown in FIG. 1, the inkjet printer is provided with a printer main body 2 and a support table 3 supporting the printer main body 2 from below. Inside the printer main body 2, a tabular platen 4 which is long in the horizontal direction is provided. This platen 4 flatly supports the sheet-like recording medium from below.

In FIG. 1, although the recording medium in which the image is recorded, is not shown, the recording medium is fed in from a conveying port provided in the back surface of the printer main body 2, passes the inside of the printer main body 2 from the back to the front under the condition that it is supported on the platen 4 by a conveying mechanism arranged inside the printer main body 2, and is delivered to the outside of the printer main body 2. That is, the recording medium is conveyed in the conveying direction B in such a manner that it passes the inside of the printer main body 2 by the conveying mechanism.

The conveying mechanism is provided with, for example, a conveying motor and conveying rollers, which are not shown, and when the conveying rollers are rotated by the drive of the conveying motor, the recording medium is conveyed. The conveying mechanism is, at the time of image recording, in timed relationship with the movement of a carriage 5, which will be described later, the conveyance and the stoppage of the recording medium are repeated, and the recording medium is intermittently conveyed.

Above the platen 4, as shown in FIG. 1, a guide member 6 which is extended in the left and right direction in the inside of the printer main body 2, is arranged. A carriage 5 is supported by the guide member 6, and this carriage 5 can be moved in the left and right direction by being guided by the guide member 6. Further, the drive mechanism (the drawing is neglected) moves the carriage 5 along the guide member 6. Hereupon, hereinafter, it will be described by defining that the direction in which the carriage 5 is moved, is a scanning direction A.

Further, on the right side of the platen 4 in the scanning direction A, a maintenance unit 7 for maintaining a plurality of recording heads 20 is provided. The maintenance unit 7 is arranged in a place which is within the range of movement of the carriage 5 and below the carriage 5. Further, on the left side of the platen 4 in the scanning direction A, a plurality of ink tanks 8 for storing the ink are arranged.

Figure 2:
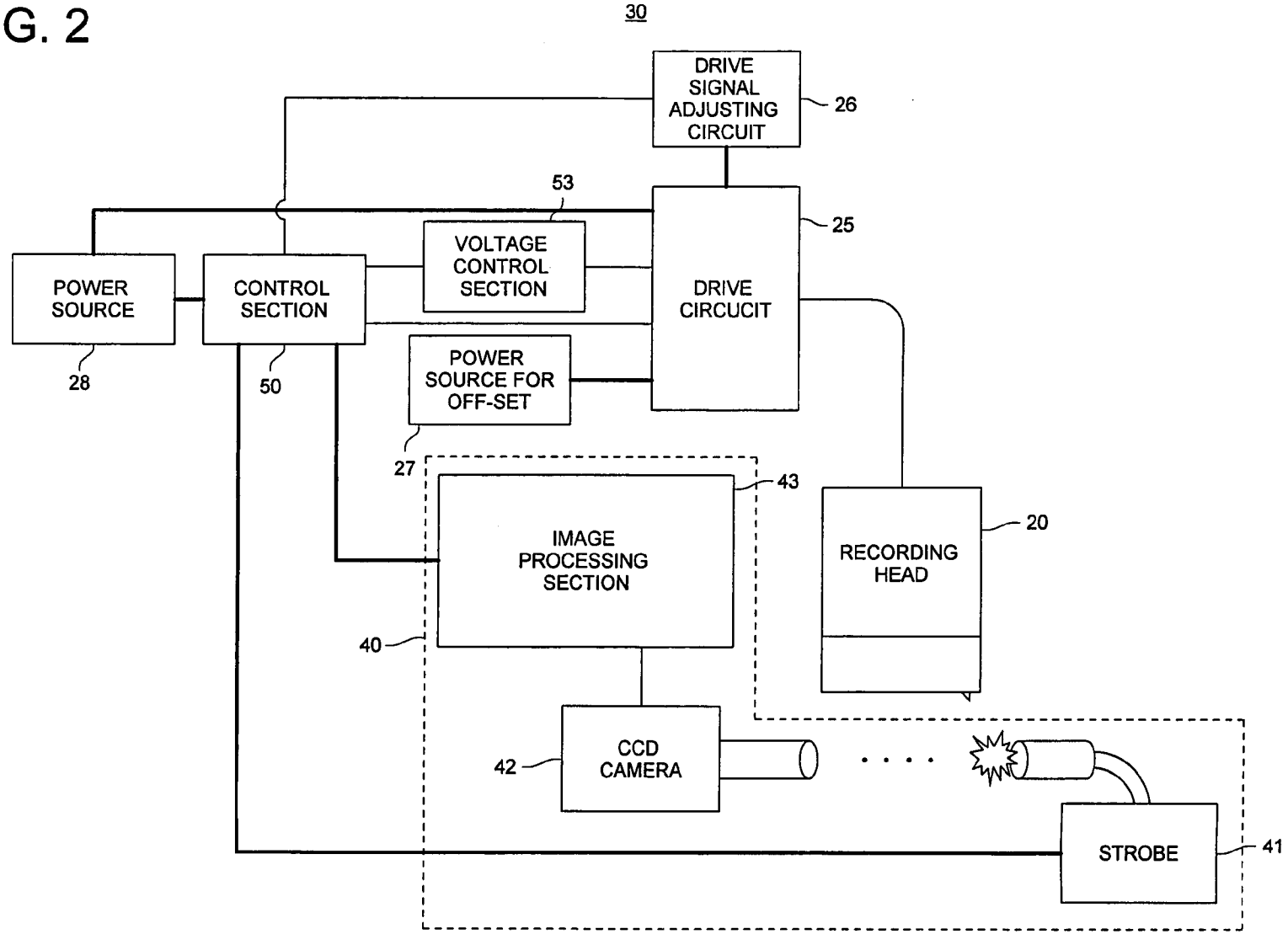
FIG. 2 is a block diagram expressing a main structure of the liquid ejecting device.

Then, in this inkjet printer 1, the liquid ejecting device 30 for ejecting the ink (liquid) onto the recording medium is provided as shown in FIG. 2.

In the liquid ejecting device 30, a plurality of recording heads 20 for ejecting the ink; a drive circuit 25 for generating the drive signal for driving the recording head 20; a drive signal adjusting circuit 26 for adjusting the waveform of the drive signal; a voltage control section (drive voltage adjusting section) 53 for adjusting the voltage value of the drive signal; a liquid detecting sensor system 40 for detecting the drop speed of the ink ejected from the recording head 20; a control section 50 for controlling the drive circuit 25, drive signal adjusting circuit 26, voltage control section 53, and liquid detecting sensor system 40; and a power source 28 for supplying the electric power to the control section 50 and drive signal adjusting circuit 26, are provided.

Figure 3:
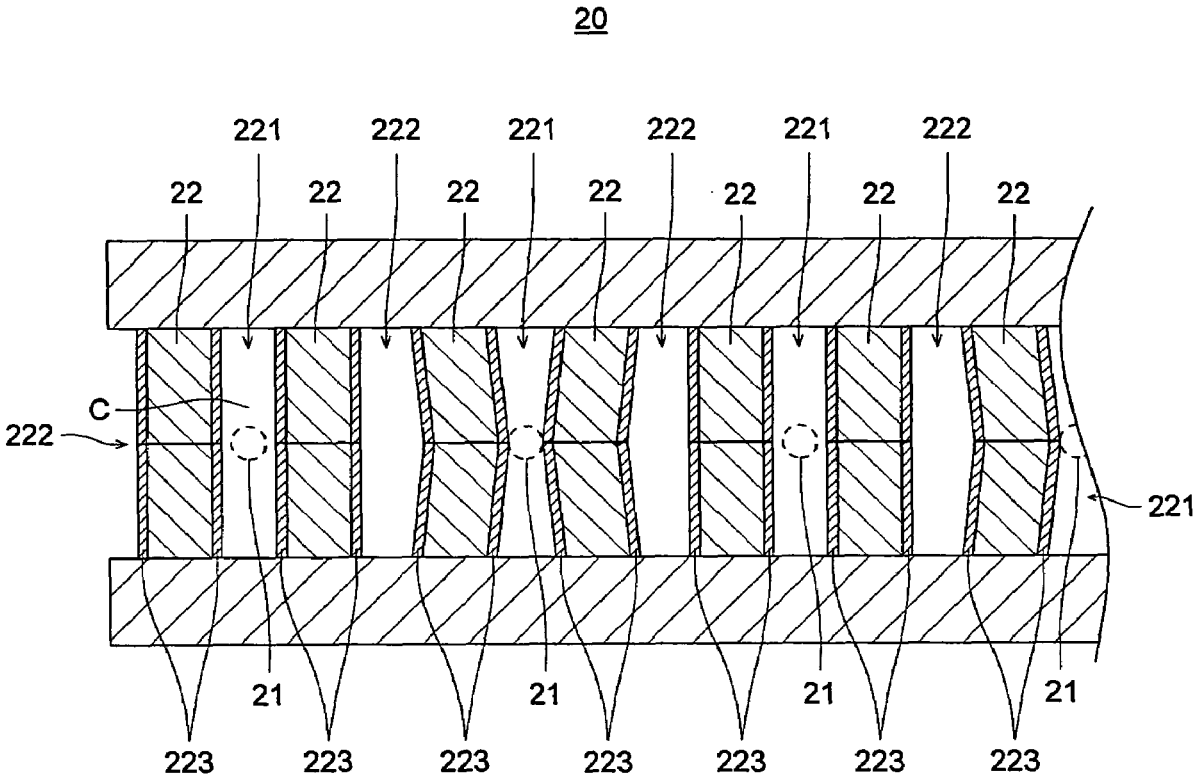
FIG. 3 is a cross-sectional view of a recording head.

As shown in FIG. 1, a plurality of recording heads 20 are mounted in a carriage 5 in such a manner that they are along the scanning direction A. FIG. 3 is a sectional view of the recording head 20, and on the ejecting surface of the recording head 20, a plurality of nozzles 21 for ejecting the ink onto the recording medium are linearly arranged. In order to eject the ink from each of these plurality of nozzles 21, an actuator 22 such as, for example, a piezo-electric element which generates the liquid ejecting energy for each of nozzles 21 is provided in the recording head 20.

In this actuator 22, a plurality of parallel ink channels 221 for guiding the ink to each of a plurality of nozzles 21 are formed. Further, in the actuator 22, an air channel 222 which is parallel to the ink channel 221 and into which the ink is not flowed, is formed between respective ink channels 221. Then, on the inside surface of the ink channel 221 and the air channel 222, an electrode 223 connected to the drive circuit 25 is provided. When the drive signal generated in the drive circuit 25 is supplied to the electrode 223, because the electrode 223 gives the voltage according to the drive signal to the actuator 22, the actuator 22 deforms corresponding to the applied voltage. This actuator 22 is deformed in such a manner that the shear mode deformation is made following the change of the voltage. By this deformation, the ink channel 221 is expanded and contracted. At the time of expansion, the ink is introduced into the ink channel 221 from ink reservoir because, in the ink channel 221, there exists a negative pressure, and at the time of contraction, because there exists a positive pressure in the ink channel 221, the ink in the ink channel 221 is ejected from the nozzle 21. In FIG. 3, C part shows the ink channel 221 at a rest position, and D part shows the ink channel 221 at the time of contraction. In this manner, because the pressure variation at the time of contraction acts as the liquid ejecting energy, the liquid ejecting energy is generated by the shear mode deformation of the actuator 22.

As shown in FIG. 2, in the liquid detecting sensor system 40, a strobe light 41 for irradiating the ink drop ejected from the nozzle 21, CCD camera 42 for photographing the ink drop irradiated by the strobe light 41, and image processing section 43 for conducting the image processing on the image data obtained by the photographing of the CCD camera 42, and for detecting the ejected drop speed of the ink, are provided. The strobe light 41 and CCD camera 42 are provided in the vicinity of the maintenance unit 7, and the photographing of the ink ejected toward the maintenance unit 7 can be conducted.

The control section 50 makes the control signal for the drive circuit 25, drive signal adjusting circuit 26 and voltage control section 53, and outputs them. Further, to this control section 50, the conveying mechanism to convey the recording medium, or the drive mechanism to scan the carriage 5, is connected.

The drive signal adjusting circuit 26 finds the waveform of the drive signal for driving the actuator 22 based on the control signal from the control section 50, and from the waveform, the adjusting signal is made, and outputted.

Figure 4:
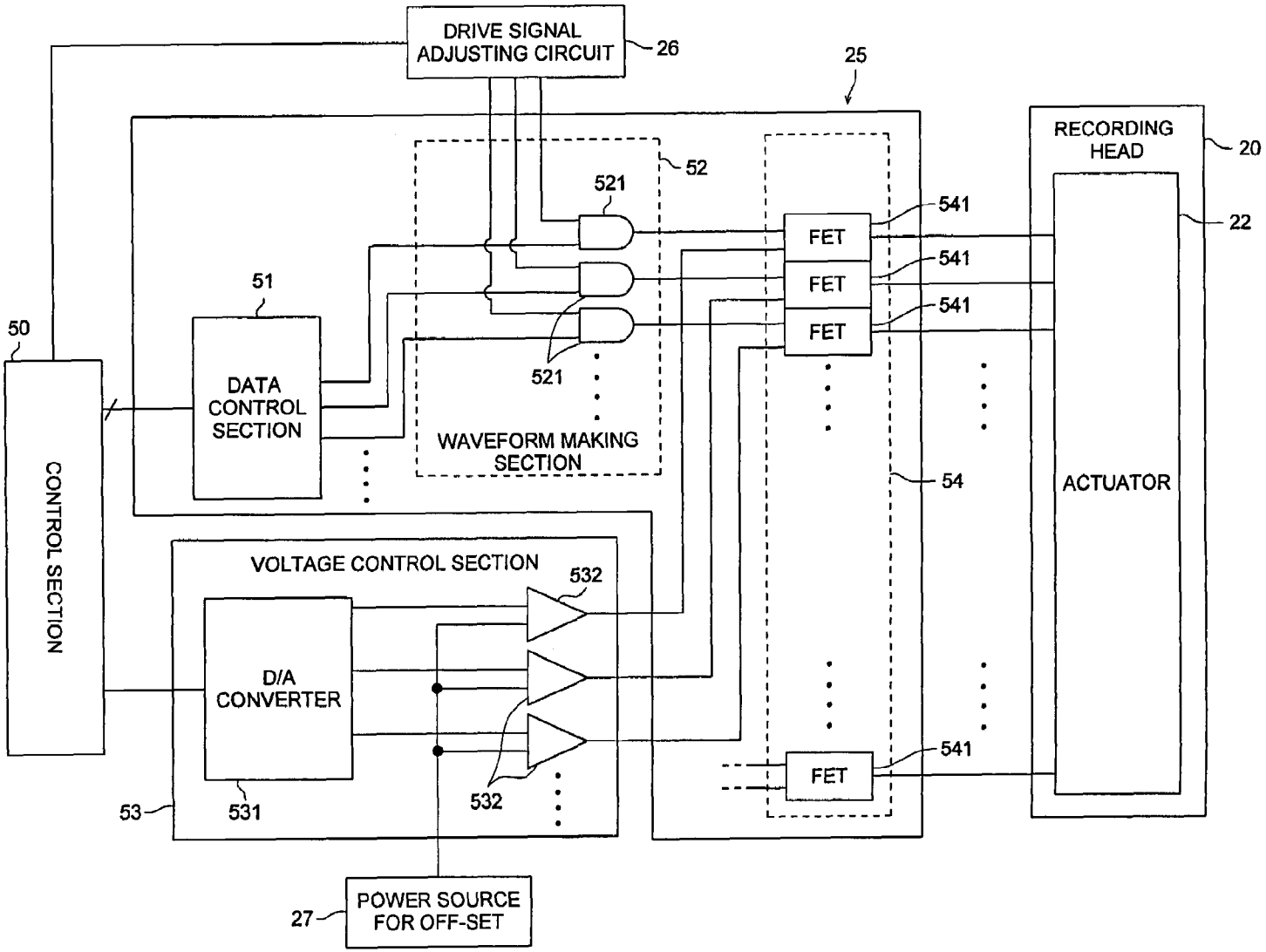
FIG. 4 is a circuit diagram expressing an outline structure of a drive circuit.

FIG. 4 is a circuit diagram expressing an outline structure of a drive circuit 25. As shown in FIG. 4, the drive circuit 25 is connected to the control section 50, and a data control section 51 for outputting the drive signal of the waveform based on the control signal from the control section 50 is provided. To this data control section 51, a waveform making section 52 for making the waveform of the drive signal corresponding to the actuator is connected. In the waveform making section 52, a plurality of AND elements 521 for corresponding to each of nozzles 21 are mounted. To the input terminal of the AND elements 521, the data control section 51 and the drive signal adjusting circuit 26 are connected, and the drive signal from the data control section 51 and the adjusting signal from the drive signal adjusting circuit 26 are inputted. When inputted these signals are compounded, the drive signal of the waveform necessary for the drive is outputted.

On the one hand, the voltage control section 53 is connected to the control section 50, and determines the voltage value based on the control signal from the control section 50. In this voltage control section 53, a plurality of D/A converters 531 for converting the control signal from the control section 50 into the analogue signal, and operational amplifiers 532 for amplifying the analogue signal from the D/A converter 531 to a predetermined voltage value are provided so as to correspond to each of nozzles 21. To the input terminal of this amplifier 532, an offset power source 27 for supplying the electric power for the offset voltage and the D/A converter 531 are connected.

Figure 5:
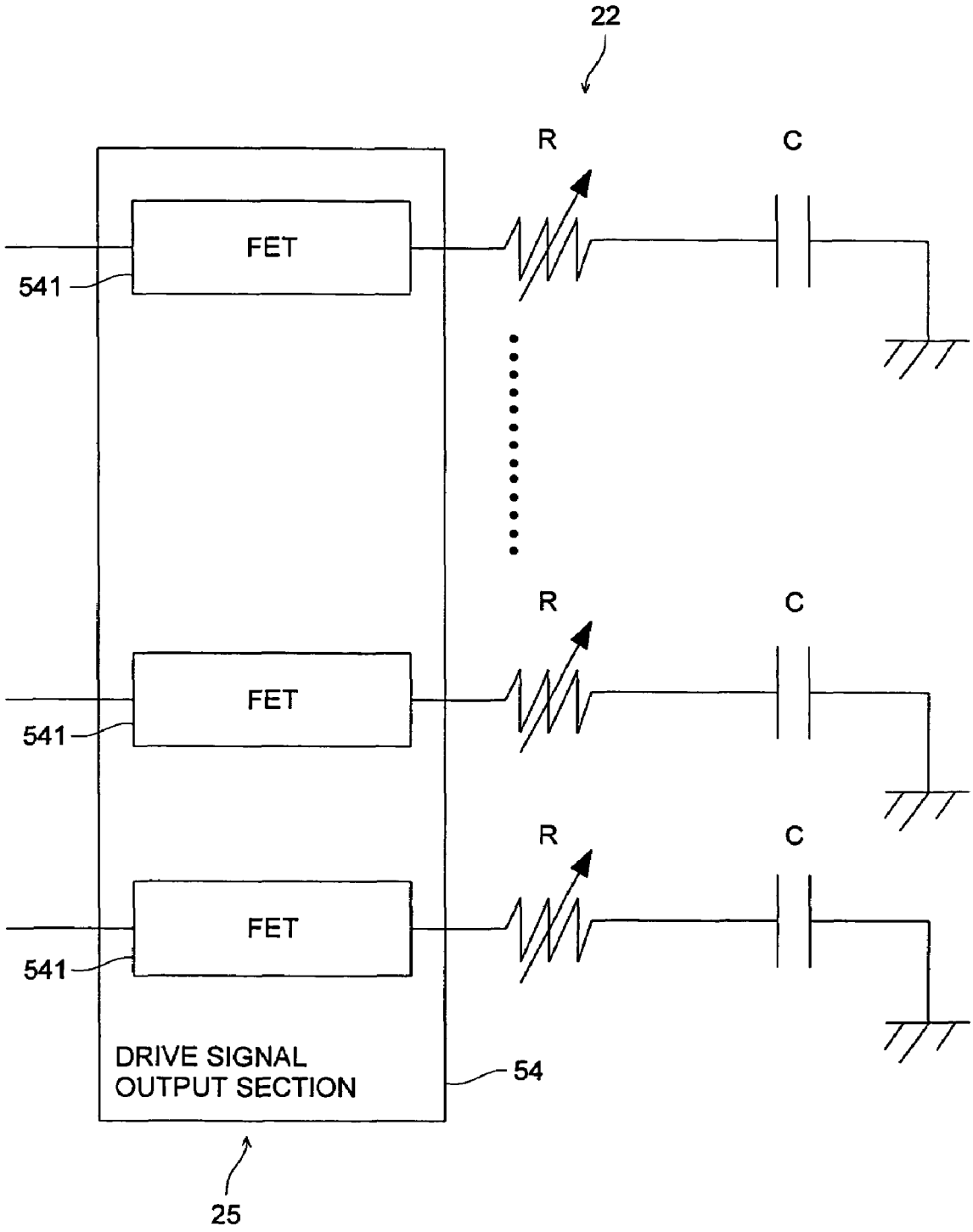
FIG. 5 is a circuit diagram showing a connection structure of an FET element provided in the dive circuit to the actuator.

Then, in the drive circuit 25, a drive signal outputting section 54 by which the drive signal from the waveform making section 52 and the voltage value from the voltage control section 53 are compounded, and which is for generating the drive signal of the individual waveform independently in each nozzle 21, is provided. In this drive signal outputting section 54, a plurality of FET elements 541 are provided. To the input terminal of each of FET elements 541, the outputting terminal of AND elements 521 of the waveform making sections 52, and the outputting terminal of the amplifier 532 of the voltage control section 53 are respectively connected, and to the outputting terminal, the electrode 223 of the actuator 22 is connected. FIG. 5 is a circuit diagram showing the connection structure of FET element 541 and the actuator 22. As shown in FIG. 5, the FET element 541 and the electrode 223 of the actuator 22 are connected through a variable resistor R. That is, when the capacitance C for each nozzle 21 of the actuator 22 is multiplied by the variable resistor R, the time constant ($\pi$=RC) is determined. As can clearly be seen from this relationship, because the time constant changes in proportion to the resistance value of the variable resistor R, the variable resistor R functions as the drive signal adjusting circuit for each nozzle independently. Hereupon, because the time constant relates, strictly speaking, not only to the resistance value of the variable resistor R, but also to the resistance value of the drive circuit 25, it is preferable that, at the time of adjusting the time constant, as the variable resistor R, the resistance value of the drive circuit 25 is also considered.

FIG. 6 is an explanatory view expressing a modified example of the waveform of the drive signal at a time before and after the time constant grant. For example, FIG. 6(*a*) expresses the waveform W1 of the drive signal at the time of input as the time before the time constant grant, and FIG. 6(*b*) expresses the waveform W2 of the drive signal at the time of output as the time after the time constant grant. As shown in FIG. 6(*a*), when it is the time before time constant grant, the rising and the falling edge of the waveform W1 are sharply dislocated, however, when the time constant is granted, as shown in FIG. 6(*b*), the rising and the falling edge of the waveform W2 are displaced after requiring the time constant $\pi$. The time constant $\pi$ in the rising edge U1 is called the rising time constant. The rising time constant is defined by a time period required when it changes from the condition that the capacitor is charged 0% to the condition that it is charged 63%. The time constant $\pi$ in the falling edge U2 is called the falling time constant. The falling time constant is defined by a time period required when it changes from the condition that the capacitor C is charged 100%, to the condition that the capacitor C is charged 37%. That is, when both the rising time constant and the falling time constant are small, the shape approximates to the waveform W1 of the drive signal at the time of the input, and when both the rising time constant and the falling time constant are large, the time period required for the rising and the falling becomes large, and the shape is dulled from that of the waveform W1.

Figure 7:
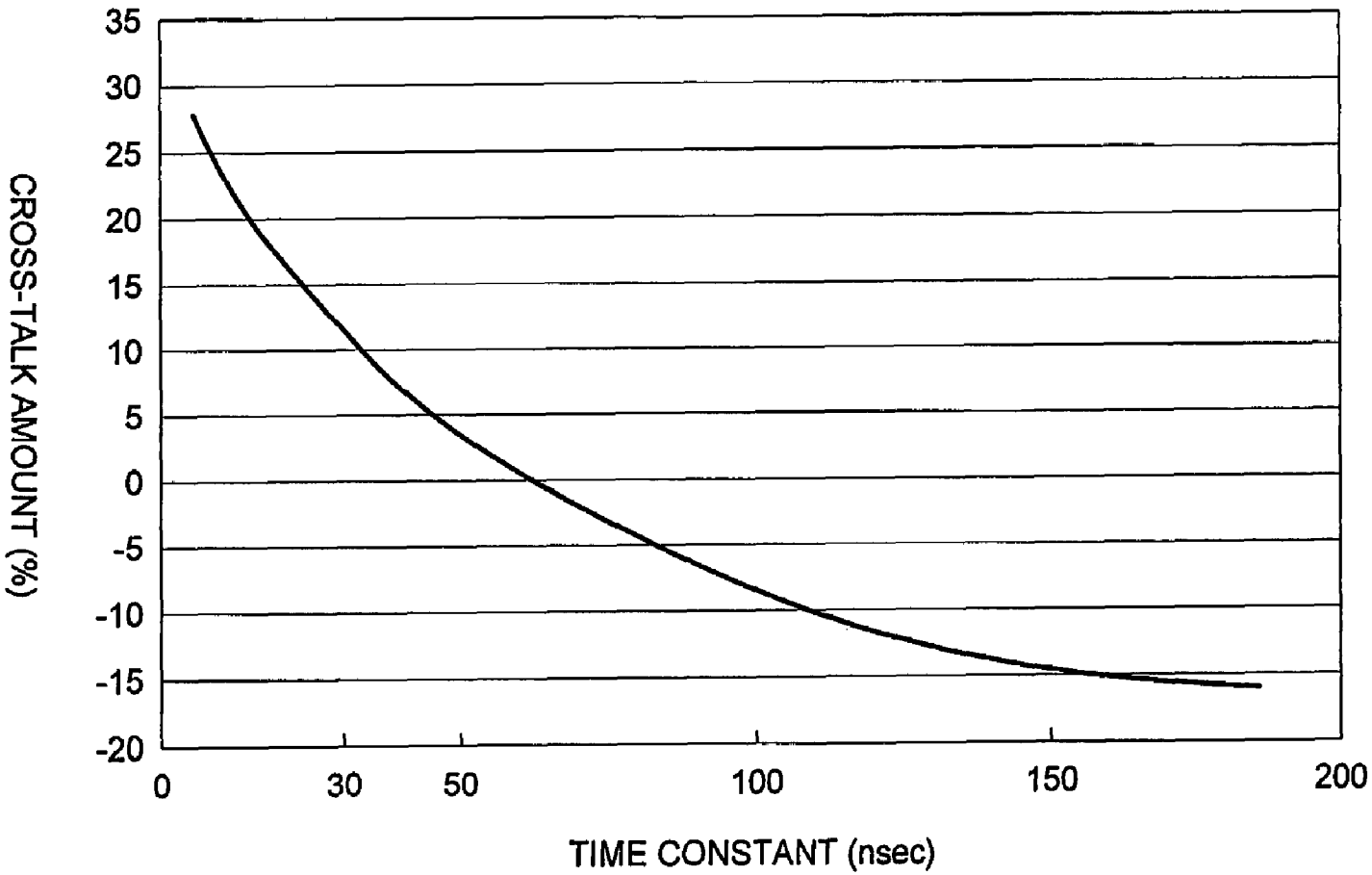
FIG. 7 is a time constant-cross—talk amount diagram showing an experimental result by which the time constant is differed and the cross-talk amount of each time constant is measured.

Herein, when the drive signal whose waveform W1 at the time of input is as it is, is transmitted to the actuator 22, because the rising and the falling edge of that waveform are very sharp and deformation of channel walls are very fast, so the vibration of the channel is propagated to the adjoining channel's ink meniscus (ink channel 221). As the result, a problem that the ejected drop speed from the adjoining nozzle 21 is increased, is generated. Further, other than the influence by this vibration of the channel, there is a factor which introduces the reduction of the ejected drop speed form the adjoining nozzle 21, such as the electric field cross-talk. When the cross-talk amount is within ±15%, the image quality which is bearable as the product is secured. Therefore, the present inventors conduct various experiments for the purpose to obtain a condition that the cross-talk amount is within the above range. FIG. 7 is the time constant—cross-talk amount diagram showing the experimental result by which the time constants are differed and the cross-talk amount of each of time constants is measured. As can also be seen from this FIG. 7, when the time constant is more than 30 nsec and less than 150 nsec, the cross-talk amount is within the range of ±15%. That is, the resistance value of the variable resistor R is adjusted so that the time constant is within the range of more than 30 nsec and less than 150 nsec.

Figure 8:
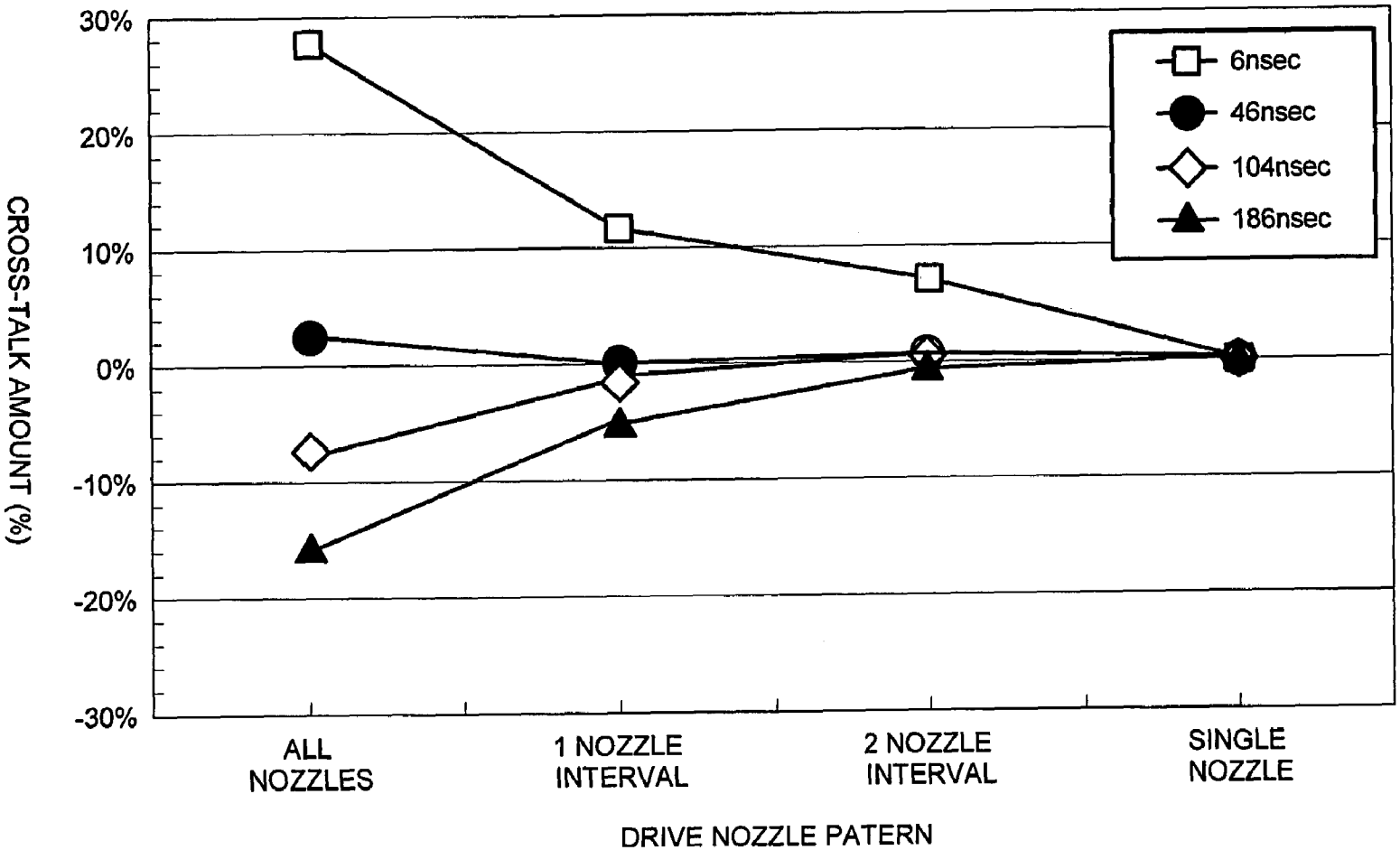
FIG. 8 is a graph expressing an influence of the cross-talk amount vs. firing pattern.
Figure 9:
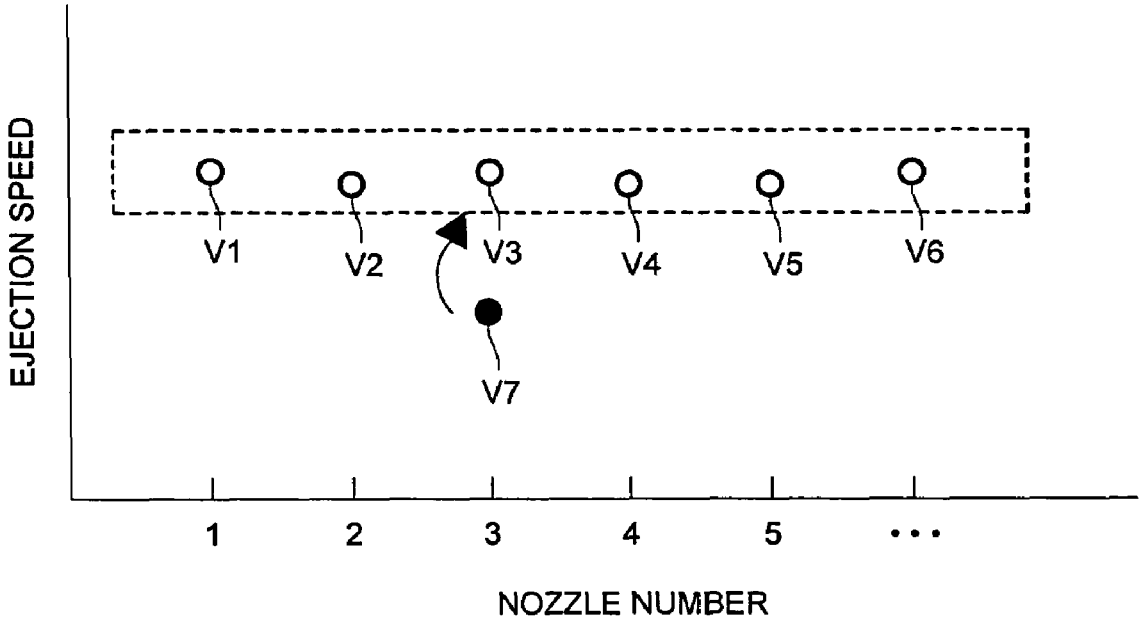
FIG. 9 is an explanatory view expressing the ejected drop speed of each nozzle when the ink is simultaneously ejected from a plurality of nozzles, and the ejected drop speed when the ink is ejected from a single nozzle.

FIG. 8 is a graph expressing the dislocation of the cross-talk amount in the case where the time constant is 6 nsec, 46 nsec, 104 nsec, 186 nsec, when the ink is ejected from all nozzles, 1 nozzle interval, 2 nozzles' interval, single nozzle only, from the recording head 20. Hereupon, the dislocation of the cross-talk amount is obtained on the base of an ejected drop speed at a single nozzle. Further, the resistance value of the variable resistor R of each time constant is 0 Ω when 6 nsec, 33 Ω when 46 nsec, 82 Ω when 104 nsec, 150 Ω when 186 nsec, and the resistance value of the drive circuit 25 is 5 Ω and the capacitance C is 1.2 nF.

As shown in FIG. 8, when the time constants are within the range of more than 30 nsec and less than 150 nsec (46 nsec, 104 nsec), the cross-talk amount also at the time of any ejection of all nozzles, 1 nozzle interval, 2 nozzles' interval, is within the range of ±15%. However, when the time constant is out of the range of more than 30 nsec and less than 150 nsec (6 nsec, 186 nsec), it is seen that the cross-talk amount at the time of all nozzle ejection is over the range of ±15%.

When the image recording by the inkjet printer is started, the control section 50 controls the conveying mechanism and the recording medium is intermittently conveyed. At the time of this intermittent conveyance, in timed relationship with the timing of the stoppage of recording medium, the control section 50 controls the drive mechanism and the drive circuit 25, and while the carriage 5 is caused to scan, the ink is ejected onto the recording medium from the recording head 20. At the time of this ejection, to the actuator 22 of the recording head 20, the rising time constant and the falling time constant which are adjusted within the range of more than 30 nsec and less than 150 nsec are granted, the ink is ejected under the condition that the cross-talk amount is within the range of ±15%. Then, when this operation is repeated, the image is recorded on the recording medium.

As described above, according to the liquid ejecting device 30 of the present embodiment, the variable resistor R adjusts the time constant of the waveform of the drive signal to more than 30 nsec and less than 150 nsec. As the result, the cross-talk amount can be within the range of ±15%. As the result, the image quality which is bearable as the product can be secured.

Further, when the variable resistance is used as the drive signal adjusting circuit, the waveform of the drive signal of the each channel can be adjusted by a simple structure independently.

Further, because the drive circuit 25 generates the reserved drive signal independently for each nozzle, the ejecting control of the ink drop can be conducted for each nozzle.

Then, because the air channel 222 is arranged between ink channels 221, the vibration and electric field of the ejected channel can be absorbed by this air channel 222. Hereby, the influence on the adjoining nozzle 21 becomes small, and the cross-talk amount can be further reduced.

Hereupon, it is of course that the invention is not limited to the above-described embodiment, but appropriately changeable.

For example, in the present embodiment, when the resistance value of the variable resistor R is adjusted, a case where the rising time constant and the falling time constant of the waveform of the drive signal are adjusted to the same value, is described. However, the rising time constant and the falling time constant may also not be the same value. Further, when at least one of the rising time constant and the falling time constant is adjusted to a value more than 30 nsec and less than 150 nsec, the cross-talk amount can be in the range within ±15%.

As described above, the liquid ejecting device as the present embodiment is described by illustrating a case where it is applied for the inkjet printer. However, the liquid ejecting device of the present invention can also be adopted to a manufacturing apparatus used for coating of an EL material of the organic EL display or coating of a color filter material of the liquid crystal display panel.

Herein, when the cross-talk amount is within the range of ±15%, the image quality which is bearable as the product is secured. The present inventors conduct various experiments in order to obtain a condition under which the cross-talk amount is within the above-described range, and find that the cross-talk amount is within a range of ±15% when at least one of the rising time constant and the falling time constant of the drive signal are made a time period more than 30 nsec and less than 150 nsec. That is, when the adjusting circuit adjusts at least one of the rising time constant and the falling time constant of the waveform of the drive signal to a time period more than 30 nsec and less than 150 nsec, the cross-talk amount can be within the range of ±15%, and as the result, the image quality which is bearable as the product, can be secured.

According to the above example, because the drive circuit generates the drive signal independently for each nozzle, the ejecting control of the ink can be conducted for each nozzle.

According to the above example, because the adjusting circuit is the variable resistance, the waveform of the drive signal can be adjusted by a simple structure.

According to the above example, because the air channel is arranged between ink channels, the influence of the channel can be absorbed by this air channel. Hereby, the influence on the ejection of the adjoining nozzle is reduced, and the cross-talk amount can be further reduced.

According to the above example, because the adjusting circuit adjusts at least one of the rising time constant and the falling time constant to a time period more than 30 nsec and less then 150 nsec, and the cross-talk amount is made within the range of ±15%, the image quality which is bearable as the product can be secured.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A liquid ejecting device comprising:

a recording head having actuators which generate the ejection energy to eject the liquid from a plurality of nozzles for each of the plurality of nozzles;

a drive circuit which generates a drive signal to drive the actuator; and an adjusting circuit for adjusting at least one of the rising time constant and the falling time constant of the waveform of the drive signal to a time period more than 30 nsec and less than 150 nsec before the drive signal reaches the actuator.

2. The liquid ejecting device of claim 1, wherein the drive circuit generates the drive signal independently for each nozzle.

3. The liquid ejecting device of claim 1, wherein the adjusting circuit has a variable resistor.

4. The liquid ejecting device of claim 1, wherein the ejection energy is generated by a shear mode of the actuator.

5. The liquid ejecting device of claim 4, wherein, in the actuator, a plurality of channels which guide the liquid to a plurality of nozzles, which are deformed based on the ejection energy and give the pressure to the liquid, are arranged with a predetermined interval; and on the inside surface of the channel, an electrode to convert the drive signal into the ejection energy is provided.

6. The liquid ejecting device of claim 5, wherein, on the actuator, air channels which are parallel to the channel, and into which the liquid is not flowed, are arranged between respective of the plurality of channels; and on the inside surface of the air channel, an electrode to convert the drive signal into the ejection energy is provided.

7. The liquid ejecting device comprising:

a recording head having actuators which generate the ejection energy for ejecting the liquid from a plurality of nozzles for each of the plurality of nozzles;

a drive circuit to generate the drive signal for driving the actuator; and an adjusting circuit for adjusting at least one of the rising time constant and the falling time constant of the waveform of the drive signal to a time period more than 30 nsec and less than 150 nsec before the drive signal reaches the actuator.

8. The liquid ejecting device of claim 7, wherein the drive circuit generates the drive signal independently for each nozzle.

9. The liquid ejecting device of claim 7, wherein the adjusting circuit is a variable resistor.

10. The liquid ejecting device of claim 7, wherein the ejection energy is generated by a shear mode of the actuator.

11. The liquid ejecting device of claim 10, wherein, in the actuator, a plurality of channels which guide the liquid to a plurality of nozzles, which are deformed based on the ejection energy and give the pressure to the liquid, are arranged with a predetermined interval; and on the inside surface of the channel, an electrode to convert the drive signal into the ejection energy is provided.

12. The liquid ejecting device of claim 11, wherein, on the actuator, air channels which are parallel to the channel, and into which the liquid is not flowed, are arranged between respective of the plurality of channels; and on the inside surface of the air channel, an electrode to convert the drive signal into the ejection energy is provided.

* * * * *